US009556530B2

(12) United States Patent
Nieminen et al.

(10) Patent No.: US 9,556,530 B2
(45) Date of Patent: Jan. 31, 2017

(54) EQUIPMENT AND METHOD FOR ELECTROLYTIC RECOVERY OF METAL

(75) Inventors: Ville Nieminen, Pori (FI); Lauri Palmu, Helsinki (FI); Henri Virtanen, Pori (FI)

(73) Assignee: Outotec Oyj, Espoo (FI)

( * ) Notice: Subject to any disclaimer, the term of this patent is extended or adjusted under 35 U.S.C. 154(b) by 221 days.

(21) Appl. No.: 13/884,999

(22) PCT Filed: Nov. 22, 2011

(86) PCT No.: PCT/FI2011/051027

§ 371 (c)(1),
(2), (4) Date: May 13, 2013

(87) PCT Pub. No.: WO2012/069701

PCT Pub. Date: May 31, 2012

(65) Prior Publication Data

US 2014/0231269 A1 Aug. 21, 2014

(30) Foreign Application Priority Data

Nov. 23, 2010 (FI) ..... 20100390

(51) Int. Cl.
*C25C 7/06* (2006.01)
*C25C 1/12* (2006.01)

(52) U.S. Cl.
CPC .. *C25C 7/06* (2013.01); *C25C 1/12* (2013.01)

(58) Field of Classification Search
CPC ..... C25C 1/12; C25C 7/06
See application file for complete search history.

(56) References Cited

U.S. PATENT DOCUMENTS

| | | | | |
|---|---|---|---|---|
| 1,365,033 | A * | 1/1921 | Greenawalt | 204/242 |
| 3,928,152 | A | 12/1975 | Harvey et al. | |
| 5,560,875 | A * | 10/1996 | Meshengisser et al. | 261/122.1 |
| 2007/0251828 | A1 | 11/2007 | Grazier et al. | |
| 2010/0065433 | A1 | 3/2010 | Heiremans | |

FOREIGN PATENT DOCUMENTS

GB 1392705 A 4/1975

OTHER PUBLICATIONS

International Search Report for PCT/FI2011/051027, completed Aug. 13, 2012, mailed Aug. 15, 2012, 4 pages.

* cited by examiner

*Primary Examiner* — Ciel Thomas
(74) *Attorney, Agent, or Firm* — Chernoff, Vilhauer, McClung & Stenzel LLP

(57) ABSTRACT

The invention concerns a system of gas ducts (6) for transporting gas, for example, into electrolytic equipment, in connection with which there are means (13) for taking at least gas into the system of gas ducts, whereby there is a suitable number of gas supply holes (7) in the system of gas ducts in a wall (19) limiting the system of gas ducts, whereby the material, such as gas, flowing in the system of gas ducts (6) is prevented at least in part from passing through the wall (19) of the system of gas ducts (6). The invention also concerns equipment and a method for electrolytic recovery of metal, such as copper.

14 Claims, 3 Drawing Sheets

EQUIPMENT AND METHOD FOR ELECTROLYTIC RECOVERY OF METAL

CROSS-REFERENCE TO RELATED APPLICATION

Figure 1:
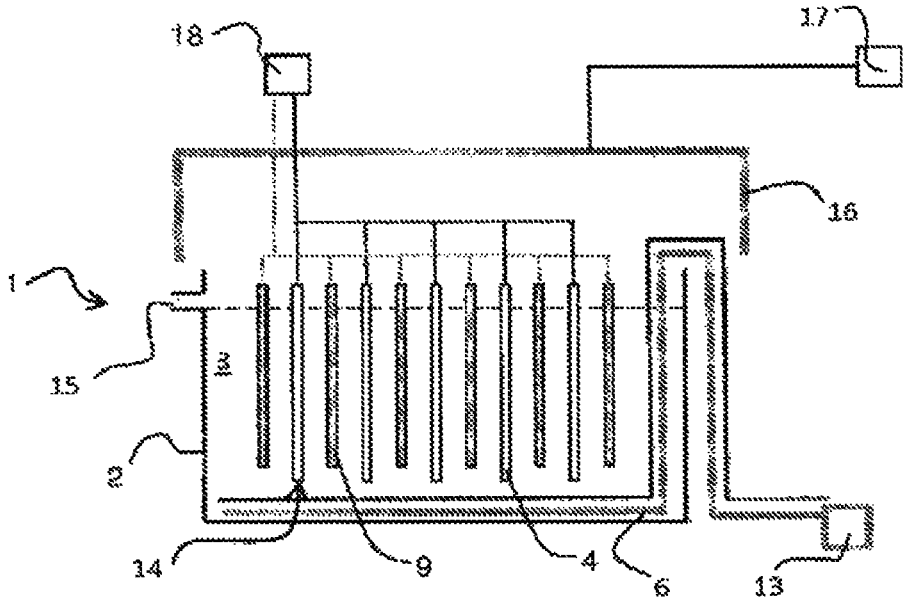

This is a national stage application filed under 35 USC 371 based on International Application No. PCT/FI2011/051027 filed Nov. 22, 2011, and claims priority under 35 USC 119 of Finnish Patent Application No. 20100390 filed Nov. 23, 2010.

FIELD OF THE INVENTION

The invention concerns a gas duct system as well as equipment and a method for electrolytic recovery of metal, such as copper, as defined in the independent claims.

BACKGROUND OF THE INVENTION

Electrolytic recovery, for example, is used as a hydrometallurgic method when production of pure metal, such as copper, is the objective. In the recovery electrolysis, copper is reduced directly from the electrolytic solution, which is a copper sulphate solution. In the process, copper is precipitated on to the surface of cathodes made of, for example, acid-proof steel, whereupon the copper is removed mechanically from the plate surface. The anodes are insoluble metal plates in the process. The precipitation rate of the metal, such as copper, depends on the current density, but this can not be increased indefinitely without lowering the quality of the precipitate. In practice, the highest possible current density is determined by the so-called critical maximum current density, that is, the highest current density, when the precipitate is still of a sufficiently high quality, which is proportional, for example, to the content of metal to be precipitated and inversely proportional to the thickness of the so-called diffusion layer.

It is known in the art to boost electrolytic recovery by bubbling, that is, by blowing gas into the electrolyte basin. The mass transport on to the cathode surface improves, because bubbling reduces the thickness of the diffusion layer. It is hereby possible to use a higher current density without lowering the surface quality of the precipitate.

A method and equipment for bubbling in electrolytic recovery are known from the US 2007/0251828 publication. According to this method, the process produced air bubbles with a diameter of 0.5-3 millimeters, and a pipe system of a porous material is used for supplying bubbling gas into the basin.

It is also known that the use of very small air bubbles is more advantageous for the recovery process as it promotes the production of a thinner diffusion layer on the cathode surface, which will for its part allow the use of a higher current density without resulting in a poorer precipitate quality.

PURPOSE OF THE INVENTION

The purpose of the invention is to present a new and more efficient way of electrolytic production of metal, such as copper. A particular purpose of the invention is to bring about a new kind of equipment and method for electrolytic recovery of metal, such as copper, in a manner wherein the production of gas bubbles on the electrolyte and further on the cathode surfaces is controlled by equipment according to the invention. In accordance with the invention, the formation of bubbles in the basin preferably takes place in such a way that the joining together of bubbles and the formation of large bubbles are prevented.

SUMMARY OF THE INVENTION

The characteristic features of the invention emerge from the appended claims.

With the solution according to the invention it is possible to use a higher current density without lowering the quality of the metal precipitate. The production capacity of plants can thus be increased. The gas bubbles promoting process conditions in the basin can be kept small enough, which promotes an optimum mixing event on the cathode surface. With the aid of the invention an even wall of bubbles of a small size can be achieved using a lower pressure and with an even lower energy consumption than before.

LIST OF FIGURES

Figure 2:
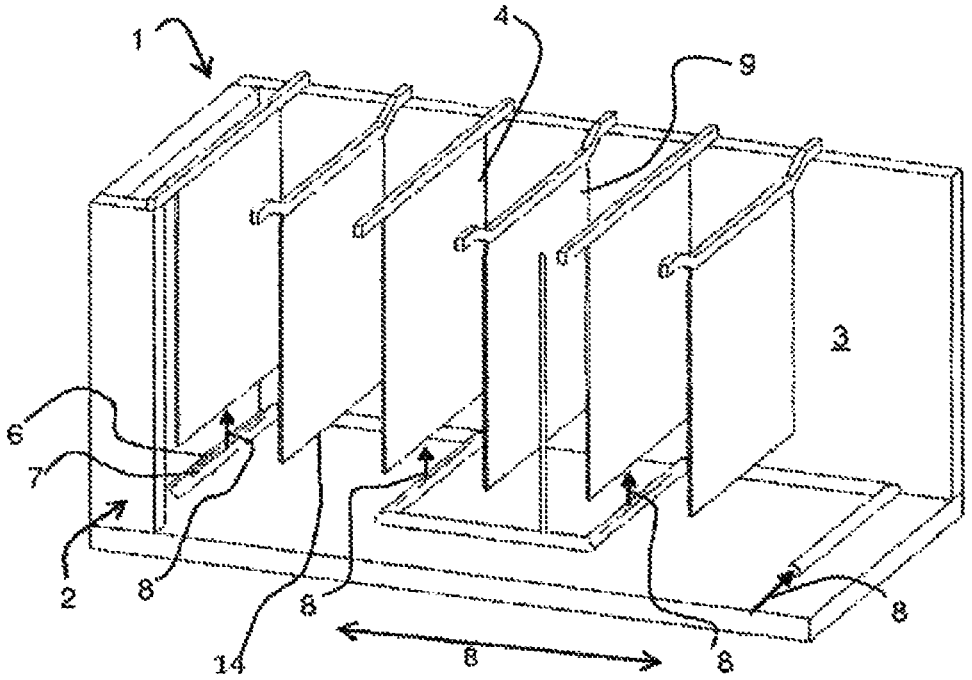
Figure 3A:
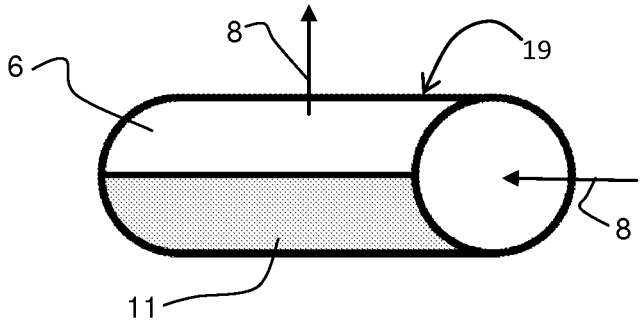
Figure 3B:
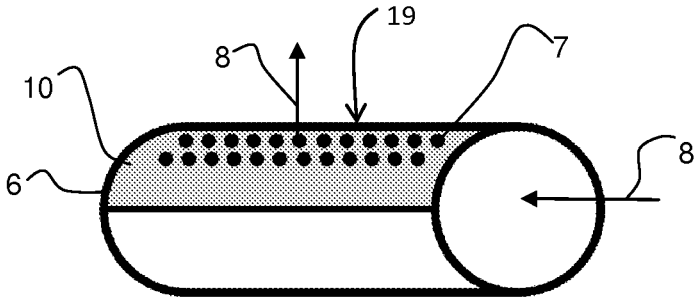
Figure 4:
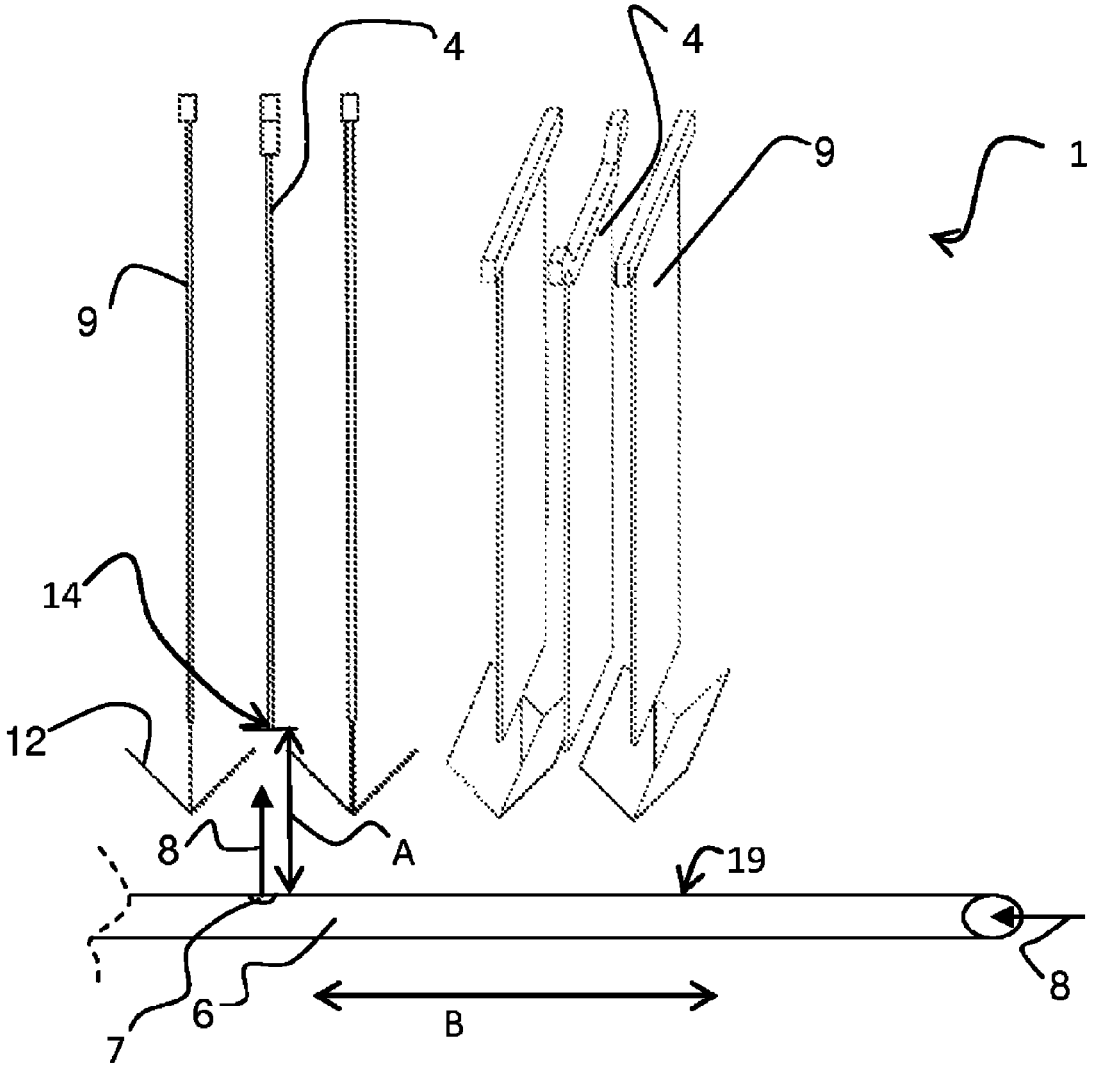

The equipment according to the invention is described in greater detail by referring to the drawing, in which FIG. 1 is an overall view of the invention;

FIG. 2 shows equipment in accordance with an embodiment of the invention;

FIG. 3*a* shows an embodiment of the invention;

FIG. 3*b* shows an embodiment of the invention;

FIG. 4 shows an embodiment of the invention.

DETAILED DESCRIPTION OF THE INVENTION

The invention is illustrated in FIG. 1, which shows an electrolytic recovery process, and in FIG. 2 showing a related piece of electrolysis equipment 1 according to an embodiment of the invention. In a basin 2, in which there is an electrolyte 3 containing metal, such as copper to be reduced, a suitable number of cathodes 4 are suspended, so that the direction of suspension is the lengthwise direction of the basin. There are, of course, anodes 9, between the cathodes in the basin. According to an embodiment of the invention, a suitable number of gas supply holes 7 are arranged in a system of gas ducts 6, such as a piping, in a wall 19 limiting the system of gas ducts for transporting gas into the equipment 1 for electrolytic recovery of metal, that is, into electrolysis equipment. In connection with the equipment there are means 13 for taking at least gas into the system of gas ducts, whereby the material flowing in the system of gas ducts 6, such as gas 8, is prevented at least in part from passing through the wall 19 of the system of gas ducts 6. The invention concerns a method for electrolytic recovery of metal, such as copper, whereby anodes 9 and cathodes 4 are placed in turns in the basin 2 into an electrolytic solution 3 containing metal ions, whereby gas bubbles 8 are spread out into the electrolytic solution, whereby gas bubbles are spread out on to the surfaces of cathodes 4 from the system of gas ducts, in which the passage of gas through wall 19 of the system of gas ducts is prevented in part.

According to an embodiment of the invention, the bubbling device 13 belonging to the equipment 1 contains a piping 6, which has gas supply holes 7 for supplying gas into the electrolytic solution 3. In addition, the bubbling device 13 contains means for producing gas bubbles and for controlling the volume of air supplied for their production, such as a pump. Electrolyte is removed from the basin, for example, as an overflow 15 or by pumping it into a separate container. Above the basin 2 there is a hood 16, from which the acid fog formed in the process is recovered by a treating device 17, In addition, a current source 18 is connected to the basin to produce a current for the process.

In the system of gas ducts 6 of the equipment 1 there is a sufficient number of gas supply holes 7, from which gas bubbles are spread out under the effect of a pressure into the electrolyte 3 and further on to the surfaces of cathodes 4, where they will affect the thickness of the diffusion layer. In accordance with the example, the system of gas ducts consists of a piping 6 and of a porous material, whereby the diameter of the supply holes 7 therein is less than 3 millimeters. According to the example shown in FIG. 2, the piping of the bubbling device is placed in the basin 2 at least partly in a perpendicular position in relation to the suspension direction B of the cathodes 4. The piping 6 of the gas supply device consists, for example, of pipes, which are placed in a perpendicular position in relation to the suspension direction of the cathodes and which are connected to each other in such a way that gas is allowed to pass between the pipes. In accordance with an embodiment of the invention, it is also possible to make the system of gas ducts 6 from one piece by bending. The gas supply holes 7 of the piping are located in such a way in the piping 6 that the bubbles are allowed to discharge directly upwards in basin 2 without colliding with each other as the gas 8 is discharging from the supply hole 7. In passing through the holes formed in the piping wall, the gas will form bubbles, which will end up on the cathode surfaces. According to the invention, the access of gas through the piping wall is prevented in part. The gas is guided to be carried through wall 19 of piping 6 in the part located on the side of cathode 4. The gas penetrates the wall at the wall on the side of the cathodes of the piping, from which the bubbles are free to ascend directly on to the cathode surfaces. According to the invention, the diameter of the piping is preferably within a range of 4-40 millimeters.

In accordance with the invention, the piping for supplying gas can be implemented in different ways. According to the embodiment shown in FIG. 3*a*, the piping is of a porous gas-permeable material, whereby the gas supply holes preferably have a diameter of less than 3 millimeters. According to an embodiment of the invention, a separate part 11 impermeable to gas is placed when required as a replacement into the wall 19 of piping 6 to prevent gas from passing through the wall. That part of the piping, which is on the side of the basin bottom, can hereby be coated at least in part with a gas-impermeable material 11, which can be exchanged easily, such as paint, lacquer or glue. The piping can advantageously be implemented in such a way that the walls of the piping are impermeable to gas in a place, such as the part on the side of the basin bottom, where passage of gas will cause a harmful effect to the process. FIG. 3*b* shows an example of a way of embodying the invention, in accordance with which there are gas supply holes in the pipe wall on that side only, where the gas penetrates the pipe. That part of the piping, which is gas-permeable, is coated with a material promoting the disintegration of gas bubbles. According to the example, the gas supply holes 7 of piping 6 are also coated with a material 10 promoting the splitting up of gas bubbles to become even smaller, such as with an industrial fabric. According to an embodiment of the invention, the piping 6 functioning as the system of gas ducts is formed of a sufficient number of interconnected pipes, in which there are gas supply holes 7 at least in that place of the pipe, which is located under the cathode 4. According to an advantageous embodiment of the invention, no more than a 70% part of the surface area of the wall of the system of gas ducts is gas-permeable.

The embodiment presented in FIG. 4 shows a situation where the piping 6 functioning as the system of gas ducts of the bubbling device is placed in the basin in a parallel position in relation to the direction of suspension B of cathodes. The guiding of bubbles 8 on to the surfaces of cathodes is thus promoted with the aid of guiding elements 12. The bubbling device 13 is placed in the basin in such a way that the distance A of the top edge 19 of piping 6 from the bottom edge 14 of the cathode is no more than 100 centimeters, such as preferably 5-70 cm, so that the bubbles are guided from piping 6 in an optimum manner to both sides of the cathode. The guiding elements can be located in the spaces between the cathodes, such as, according to the example, in the anodes located in the spaces between the cathodes. The guiding element 12 is an element guiding the flow and guiding the gas bubbles in the desired direction.

In the following, the invention is illustrated with the aid of examples.

Example 1

About 10 m of seepage hose was placed in a framework forming nine rows, each row one meter long. The hose was treated with suitable glue, so that the air to be blown through the pipe was not allowed to penetrate from the pipe walls other than directly upwards. The framework was placed in a transparent cell, which was filled with water. When blowing air into the seepage hose piping at a rate of 120 ml $m^{-1}$ $min^{-1}$ from the hoses, an even bubble wall resulted with the bubble size varying within a range of 0.1-3 mm.

Example 2

An industrial fabric was wrapped tightly around a metal pipe having holes pointing directly upwards. The pipe was placed on the bottom of an electrolysis cell having a height of 1.2 m (width 25 cm, volume 62 L) under a steel plate functioning as a cathode, so that when blowing air into the piping, bubbles were distributed from the bottom edge of the cathode and they ascended uniformly to both sides of the cathode. The cell was filled with an electrolyte containing 40 g/l of copper and 175 g/l of sulphuric acid. 46.5 L/h of electrolyte was supplied into the cell and the temperature of the electrolyte was 45° C. during the test. Copper was precipitated on to the cathode surface for 24 h using a current density of 450 $Am^{-2}$, at the same time blowing air through the piping. The surface of the copper precipitate formed was examined with a SEM microscope (scanning electron microscope) and with an optical microscope. In addition, a cross-sectional micro-section was examined with an optical microscope. The precipitate had a smooth surface, it was dense, the crystalline growth was uniform and the grain boundaries were difficult to detect in the SEM image. The test was repeated without bubbling, whereby the copper precipitate was rough, porous and the grain size was quite large.

Example 3

With the equipment of Example 2, a bubbling piping was placed in a transverse position against the cathodes. Guiding components were attached to the anodes to guide the bubbles uniformly on to the cathode surface. The test according to Example 2 was repeated using a current density of 450 $Am^{-2}$ and the copper precipitate was examined. The precipitate had a smooth surface, it was dense and the crystalline growth was uniform, as in the case of Example 2, where the copper precipitate was produced with the aid of bubbling.

It is obvious to a person skilled in the art that as the technology develops the basic idea of the invention can be implemented in many different ways. Thus, the invention and its embodiments are not limited to the examples described above, but they may vary within the scope defined by the claims.

The invention claimed is:

1. A system of gas ducts for transporting gas into electrolysis equipment, and including a wall limiting the system of gas ducts, the wall defining a plurality of gas supply holes arranged on the wall so as to discharge gas bubbles from the surface of the gas ducts in a directly upwards direction and from respective locations each directly beneath a bottom edge surface of a cathode having opposed lateral side surfaces, such that the bottom edge surface distributes a column of bubbles ascending from directly beneath the bottom edge surface uniformly among the opposed lateral side surfaces of the cathode.

2. The system of gas ducts as defined in claim 1, characterized in that the system of gas ducts is made of a porous material, whereby the diameter of the plurality of gas supply holes located therein is less than 3 mm.

3. The system of gas ducts as defined in claim 1, characterized in that at least a part of the system of gas ducts is coated with a material impermeable to gas.

4. The system of gas ducts as defined in claim 3, characterized in that the material comprises a fluid that dries into a gas-impermeable barrier after application to the system of gas ducts.

5. The system of gas ducts as defined in claim 1, characterized in that the system of gas ducts is formed of a plurality of interconnected pipes.

6. The system of gas ducts as defined in claim 1, characterized in that the system of gas ducts is formed of a bent a solid piece.

7. The system of gas ducts as defined in claim 1, characterized in that the gas ducts have a diameter in a range of 4-40 mm.

8. The system of gas ducts as defined in claim 1, characterized in that the gas ducts are coated with a material promoting disintegration of gas bubbles.

9. The system of gas ducts as defined in claim 1, characterized in that no more than 70% of the wall surface area of the system of gas ducts is gas-permeable.

10. The system of claim 1 including at least one guiding element respectively positioned to guide bubbles in said column to the bottom edge surface.

11. The system of claim 10, characterized in that the distance of a top edge of the system of gas ducts from a bottom edge of the cathode is no more than 100 cm.

12. The system of claim 10 having a plurality of suspended cathodes, and characterized in that the system of gas ducts is placed at least partly in a perpendicular position in relation so a suspension direction of the plurality of cathodes.

13. The system of claim 10 having a plurality of suspended cathodes, and characterized in that the system of gas ducts is placed in a parallel position in relation to a suspension direction of the plurality of cathodes.

14. The system of claim 10 having a plurality of cathodes and at least one guiding element positioned between adjacent ones of said plurality of cathodes so as to guide material supplied to the system to a surface of a respective one of said plurality of cathodes.

* * * * *